US010071470B2

(12) United States Patent
Arketa Zabala

(10) Patent No.: US 10,071,470 B2
(45) Date of Patent: Sep. 11, 2018

(54) HANDLE FOR CLEANING TOOL OR SIMILAR

(71) Applicant: ERRE USE EVOLUTION, S.L., Leioa-Vizcaya (ES)

(72) Inventor: Unai Arketa Zabala, Leioa-Vizcaya (ES)

(73) Assignee: ERRE USE EVOLUTION, S.L., Leioa (Bizkaia) (ES)

( * ) Notice: Subject to any disclaimer, the term of this patent is extended or adjusted under 35 U.S.C. 154(b) by 0 days.

(21) Appl. No.: 14/764,677

(22) PCT Filed: Sep. 30, 2013

(86) PCT No.: PCT/ES2013/070673
§ 371 (c)(1),
(2) Date: Jul. 30, 2015

(87) PCT Pub. No.: WO2014/135719
PCT Pub. Date: Sep. 12, 2014

(65) Prior Publication Data

US 2015/0367499 A1 Dec. 24, 2015

(30) Foreign Application Priority Data

Mar. 6, 2013 (ES) ..... 201330269 U

(51) Int. Cl.
*A46B 5/02* (2006.01)
*B25G 1/10* (2006.01)
(Continued)

(52) U.S. Cl.
CPC ..... *B25G 1/10* (2013.01); *A46B 5/025* (2013.01); *A47L 13/46* (2013.01); *B25G 1/102* (2013.01);
(Continued)

(58) Field of Classification Search
CPC ..... A46B 5/002; A46B 5/00; A46B 5/0095; A46B 5/0058; A46B 5/0045; B25G 1/00
(Continued)

(56) References Cited

U.S. PATENT DOCUMENTS 3,947,915 A 4/1976 Kroll
4,381,766 A * 5/1983 Avolio ..... A46B 5/0033 15/143.1
(Continued)

FOREIGN PATENT DOCUMENTS

CA 2342462 A1 * 9/2001 ..... A46B 5/02
CN 202020386 U 11/2011
(Continued)

OTHER PUBLICATIONS

International Search Report for international Application No. PCT/ES2013/070673 dated Feb. 24, 2014.
(Continued)

*Primary Examiner* — Michael Jennings
(74) *Attorney, Agent, or Firm* — Brown & Michaels, PC

(57) ABSTRACT

Handle for cleaning tool or similar which has an elbow at an intermediate point which defines a lower straight section and an upper section which externally forms a widened surface with a configuration and length adapted to the forearm of an individual which at the front end ends in a flexible clamp which secures the forearm of the user in an area close to the elbow while on the same exterior face and close to the angled area of the handle there is a handhold in such a manner that it can be applied both on the ground or on a low surface as well as on the ceiling or an elevated surface above the head of the user.

11 Claims, 2 Drawing Sheets

(51) Int. Cl.
*A47L 13/46* (2006.01)
*B25G 3/00* (2006.01)

(52) U.S. Cl.
CPC ..... *B25G 3/00* (2013.01); *A46B 5/02* (2013.01); *A46B 2200/302* (2013.01)

(58) Field of Classification Search
USPC ..... 15/144.1, 144.2, 144.3, 144.4, 426, 430
See application file for complete search history.

(56) References Cited

U.S. PATENT DOCUMENTS 4,704,758 A * 11/1987 Hoffman ..... B25G 1/04 15/143.1
4,809,388 A * 3/1989 Dietrich ..... A46B 5/02 15/143.1
D359,605 S * 6/1995 Janikowski ..... D32/50
5,455,981 A * 10/1995 Wiese ..... A47L 13/022 15/143.1
5,529,357 A * 6/1996 Hoffman ..... A01B 1/026 15/145
5,606,772 A * 3/1997 Ilic ..... A01B 1/00 15/145
5,791,006 A * 8/1998 Anctil ..... A46B 17/02 15/143.1
6,170,112 B1 1/2001 Mayfield et al.
6,199,245 B1 * 3/2001 Blessing ..... B25G 1/06 16/422
6,397,427 B1 * 6/2002 Bryngelsson ..... B25G 1/102 15/143.1
6,632,195 B1 * 10/2003 Smith ..... A45D 34/04 604/275
6,918,240 B2 * 7/2005 Hurt ..... A01D 7/00 56/400.04
6,918,321 B1 * 7/2005 Whittaker ..... E04D 15/003 254/131.5
7,909,526 B2 * 3/2011 Wales ..... A46B 5/0008 401/25
8,429,785 B1 * 4/2013 Royal ..... E01C 19/44 15/144.1
8,776,648 B2 * 7/2014 Lee ..... B25G 1/102 16/426
2003/0200631 A1 10/2003 Clarke
2004/0055099 A1 * 3/2004 Greenberg ..... B25G 1/102 15/143.1
2008/0052856 A1 * 3/2008 Lin ..... A46B 5/0033 15/172
2010/0005607 A1 * 1/2010 DelaBarre ..... A46B 5/02 15/143.1
2011/0099765 A1 * 5/2011 Youssefieh ..... A01D 7/00 16/430

FOREIGN PATENT DOCUMENTS

DE 10316392 A1 3/2004
DE 202004014551 U1 12/2004

OTHER PUBLICATIONS

Technical Report No. T-2016/2999, "Justification Report of Handle Design Parameter for Cleaning Tool", Nov. 2016, Exhibit A.
Inermap Technical Report PRE-ER-RHC/2013131112-01-1, "Biochemical Analysis", Jan. 2014, Exhibit B.
Instituto De Ergonomia SLU certificate, Nov. 25, 2016, Exhibit C.

* cited by examiner

HANDLE FOR CLEANING TOOL OR SIMILAR

OBJECT OF THE INVENTION

The present invention relates, as is set out in the title, to a handle of the type which is used in brooms or other cleaning tools, although it can also be used as an accessory for paint rollers or any other tools which use an elongated handle which, for the use thereof, is held at an area close to the front end, whether it be with one or with two hands.

BACKGROUND OF THE INVENTION

At present there exist on the market handles for brooms, brushes, rollers, etc. formed by an elongated element made of wood, plastic or metal, fixed or telescopic which are held with the hands at the area of the front end, mounting the tool at the opposing end, normally fitted at pressure, threaded or interlocked with any type of clamp.

Over the years the handles have hardly evolved in the structure and configuration thereof for making them more ergonomic and adaptable to different types of tools, which require a specific termination for the use thereof.

DESCRIPTION OF THE INVENTION

The object of the present invention is therefore a handle which has a novel configuration and structure which make it particularly suitable for the use thereof with different tools while allowing the use of the tool in areas which were hitherto inaccessible with a conventional handle and in comfortable and ergonomic conditions for the user.

The handle of the invention has an elbow at an intermediate point, from which two section are visible: one straight lower section, at times telescopic, and an upper section which externally (on the convex face) forms a widened surface which has a configuration and length suited to the forearm. This front or upper section has at the end a termination in the form of a clamp in which it is secured to the forearm by way of an area close to the elbow while close to the angled area there is a protrusion in the form of a handle such that the entire front area of the handle is coupled on the hand and the arm of the user. The lower section of the handle, extension of the support and upper handholds forms with the latter an angle of between 135° and 165° so that when the tool is applied on the ground or on a low surface the work is effected with the arm slightly folded at the elbow whereas if work is carried out on the ceiling or on an elevated area, the position of the arm is also elevated but forming an angle approximate to 45° with the horizontal which is much more comfortable than if the arm had to be completely elevated in order to be able to access the ceiling with the tool which is being handled at that moment.

The handhold is a straight grip, fixed, perpendicular to the handle at the area of the front section. Optionally, another more complex alternative is possible, such as a transversal grip which allows the fist to be located in a position close to the horizontal or a grip adjustable in length or laterally so that it can be located as the user desires.

The exterior surface of the widened area and/or the flexible clamp, that is to say the entire area which is in contact with the forearm, optionally are soft or padded for greater comfort of the user.

The straight lower section is preferably telescopic with the aim of being adapted to the stature or preference of the individual.

DESCRIPTION OF THE FIGURES

In order to complement the description and with the aim of facilitating the understanding of the characteristics of the invention, a set of drawings accompany the present specification, in which the following are depicted in an illustrative and non-limiting manner.

PREFERRED EMBODIMENT OF THE INVENTION

Figure 1:
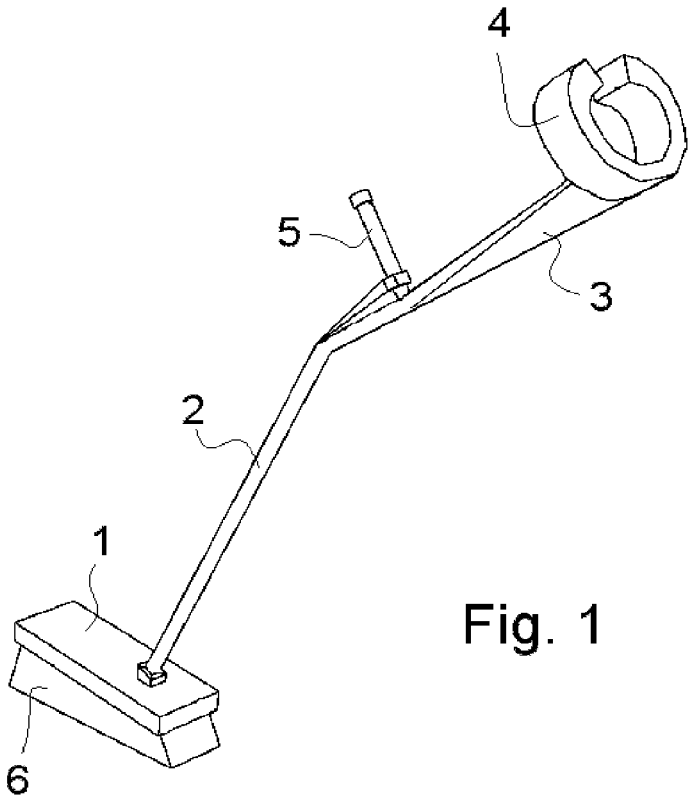
FIG. 1 shows an elevated view of this handle when the tool is used on the ground or on a low surface.
Figure 2:
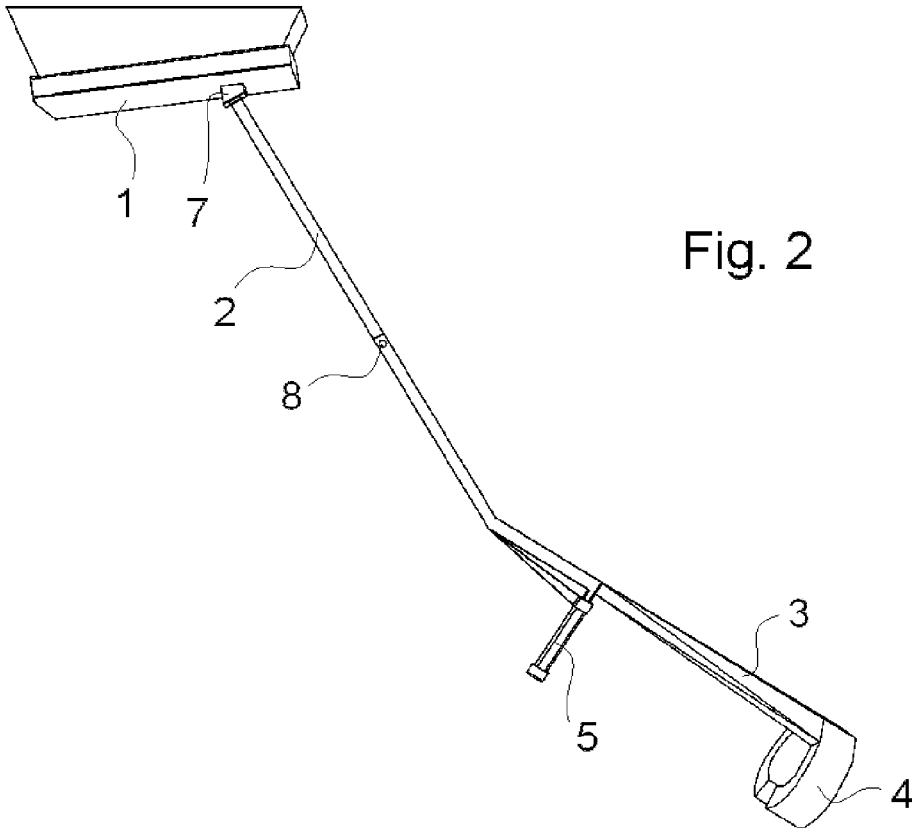
FIG. 2 is a view of the same tool in the position of use when it is used on the ceiling or on an elevated surface.

As can be observed in the referenced figures, the handle of the invention has a first straight area (2) and is provided at the rear end with a termination (7) in which it fits in the cleaning tool (1). A second portion (3) which forms an obtuse angle with the foregoing of between 165° and 135°. On the exterior face of this portion (3), that is to say, in the convex area keeping them at the angle which forms both sections of the handle, three elements are arranged:

- an intermediate widened area which is adapted to the forearm of the user, both when it is held in the natural position represented in FIG. 1 as well as in the inverse position, shown in FIG. 2.
- a flexible clamp (4) open through the exterior and located at the end of the portion (3) which accommodates the forearm and allows the piece to be firmly secured in relation to the latter.
- a handle or hand grip (5) located close to the angle which the two sections (2-3) of the handle form.

With this configuration, it is possible to hold the handle in a natural position, as the position marked in FIG. 1, introducing the forearm into the clamp (4), while with the hand the grip (5) is held. In this way, it is possible to sweep or gain access with the tool (1) to corners which would otherwise be inaccessible. If an angled termination is also provided for the bristles or existing cleaning elements (6) in the tool (1), this facilitates the operation.

In FIG. 2, the form of gripping this tool in the inverse position is observed. In this case, it is placed below the forearm, such that the clamp (4) is also secured close to the elbow, however, from the top downwards, while the grip (5) inserted inverted with the termination downwards. This position is ideal for painting or cleaning ceiling surfaces or surfaces which are elevated above the head of the operator. In this way, all the force made with the arm is transmitted directly to the stick, minimizing the effort and saving time.

The bristles of the broom (6) are envisaged to go from few to many in order to obtain the suitable angle and in this way be able to access low parts of chairs, tables, sofas, etc. This exercise is carried out with one single hand, being able to have the collector in the other and in this way collect the dirt in each sweep without having to pile it together beforehand.

Once the nature of the invention, as well as a preferred exemplary embodiment have been sufficiently described, it must be noted in an appropriate manner that the materials, shape, size and arrangement of the elements described can be modified, provided this does not involved an alteration of the essential characteristics of the invention which is claimed below:

What is claimed is:

1. A handle for a cleaning tool or similar comprising:

an elongated body having an upper straight section and a lower straight section which are joined at an intermediate point at an angle of between 135° and 165°;

a coupling means on an end of the lower straight section;

a tool on the coupling means which can be applied both on the ground or a low surface or on an elevated surface above the head of the user;

the upper straight section having a face which forms a widened surface with a configuration and length adapted to a forearm of a user;

a flexible clamp at an end of the upper straight section which secures the forearm of the user in an area close to the intermediate point; and a handhold located adjacent to the intermediate point on the face of the upper straight section, wherein a longitudinal axis of the handhold is perpendicular to the elongated body and is placed in a vertical plane when the handle is in use, the widened surface gradually increasing in width from a lower end of the upper straight section toward the flexible clamp at the end of the upper straight section.

2. The handle of claim 1, in which the handhold is a straight grip.

3. The handle of claim 1, in which an exterior surface of the widened area of the upper straight section is soft or padded.

4. The handle of claim 1, in which the lower straight section of the elongated body is telescopic.

5. The handle of claim 1, in which the flexible clamp is soft or padded.

6. A handle for a cleaning tool or similar comprising:

an elongated body having an upper straight section and a lower straight section that forms an obtuse angle of between 135° and 165° with the upper straight section;

a coupling means on an end of the lower straight section;

a tool on the coupling means which can be applied both on the ground or a low surface or an elevated surface above the head of the user;

the upper straight section having a face which forms a widened surface with a configuration and length adapted to a forearm of a user;

a flexible clamp at an end of the upper straight section which secures the forearm of the user in an area close to the obtuse angle; and a handhold located adjacent to the obtuse angle on the face of the upper straight section the widened surface gradually increasing in width from a lower end of the upper straight section toward the flexible clamp at the end of the upper straight section.

7. The handle of claim 6, in which the handhold is a straight grip, fixed perpendicular to the upper straight section of the elongated body adjacent to the obtuse angle.

8. The handle of claim 7, wherein a longitudinal axis of the handhold is placed in a vertical plane when the handle is in use.

9. The handle of claim 6, in which an exterior surface of the widened surface of the upper straight section is soft or padded.

10. The handle of claim 6, in which the lower straight section of the elongated body is telescopic.

11. The handle of claim 6, wherein the flexible clamp is soft or padded.

* * * * *